US005131248A

United States Patent [19]

Ho

[11] Patent Number: 5,131,248

[45] Date of Patent: Jul. 21, 1992

[54] STRUCTURE OF KEY AND LOCK BARREL FOR LOCK SET

[76] Inventor: Ihui Ho, No. 29, Alley 7, Lane 428, Chung Cheng N. Rd., San-Chung City, Taipei Hsien, Taiwan

[21] Appl. No.: 679,130

[22] Filed: Mar. 28, 1991

Related U.S. Application Data

[63] Continuation of Ser. No. 336,635, Mar. 23, 1989, abandoned, which is a continuation of Ser. No. 90,365, Aug. 28, 1987, abandoned.

[51] Int. Cl.[5] ..... E05B 29/00

[52] U.S. Cl. ..... 70/366; 70/405; 70/409

[58] Field of Search ..... 70/365, 366, 405–407, 70/409

[56] References Cited

U.S. PATENT DOCUMENTS

| | | | |
|---|---|---|---|
| 3,695,073 | 10/1972 | Prescott | 70/366 |
| 3,928,992 | 12/1975 | Talbot | 70/276 X |
| 4,008,588 | 2/1977 | Miller et al. | 70/366 |
| 4,111,021 | 9/1978 | Roberts | 70/406 |
| 4,127,996 | 12/1978 | Malminen et al. | 70/365 |
| 4,267,717 | 5/1981 | Martikainen | 70/366 |
| 4,359,886 | 11/1982 | Evans et al. | 70/366 |
| 4,370,875 | 2/1983 | Piironinen | 70/366 X |
| 4,409,807 | 10/1983 | Lipschutz | 70/409 X |
| 4,667,493 | 5/1987 | Takahashi | 70/366 |
| 4,686,843 | 8/1987 | Martikainen et al. | 70/366 |

FOREIGN PATENT DOCUMENTS

| | | | |
|---|---|---|---|
| 1171778 | 6/1964 | Fed. Rep. of Germany | 70/365 |
| 2245729 | 4/1974 | Fed. Rep. of Germany | 70/366 |
| 2516340 | 11/1975 | Fed. Rep. of Germany | 70/407 |
| 2627764 | 1/1977 | Fed. Rep. of Germany | 70/366 |
| 3526173 | 1/1987 | Fed. Rep. of Germany | 70/366 |
| 1349016 | 3/1974 | United Kingdom | 70/366 |
| 2129045 | 5/1984 | United Kingdom | 70/365 |

*Primary Examiner*—Renee S. Luebke
*Assistant Examiner*—Suzanne L. Dino
*Attorney, Agent, or Firm*—Lowe, Price, LeBlanc & Becker

[57] ABSTRACT

A new structure of key and lock barrel for lock set, comprising holder, nut, rotating body, braking bar, washers, barrel plates, covering plate and key; by inserting the key into the rectangular space of all barrel plates and by turning to let its slant faces of different depth push all barrel plates one after another to rotate and turn the notch of all barrel plates to one radial location, the braking bar falls into rotating body to let it rotate within the holder so as to drive corresponding lock plug making the lock open.

1 Claim, 3 Drawing Sheets

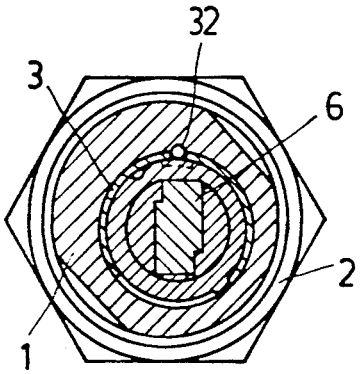
Fig 3-A
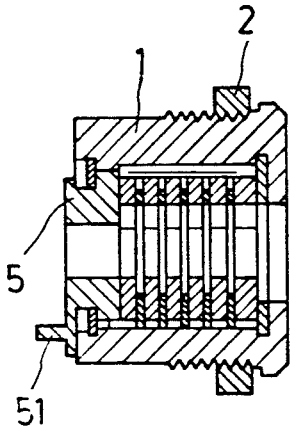
Fig 2
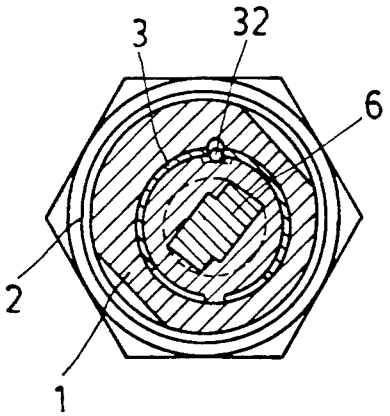
Fig 3-B
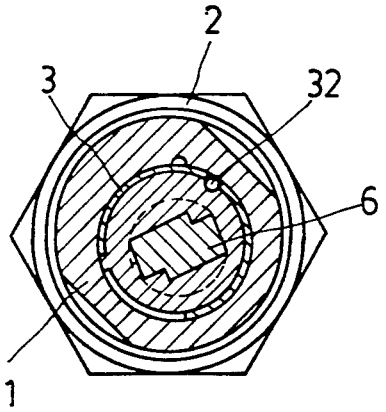
Fig 3-C

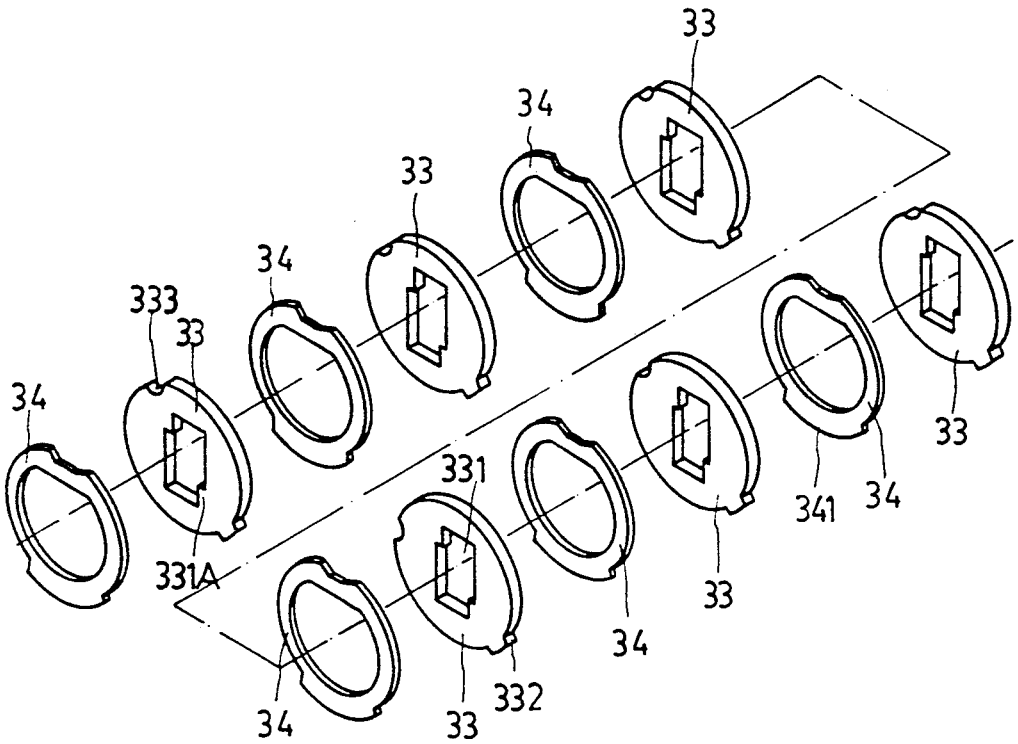
Fig 4-A
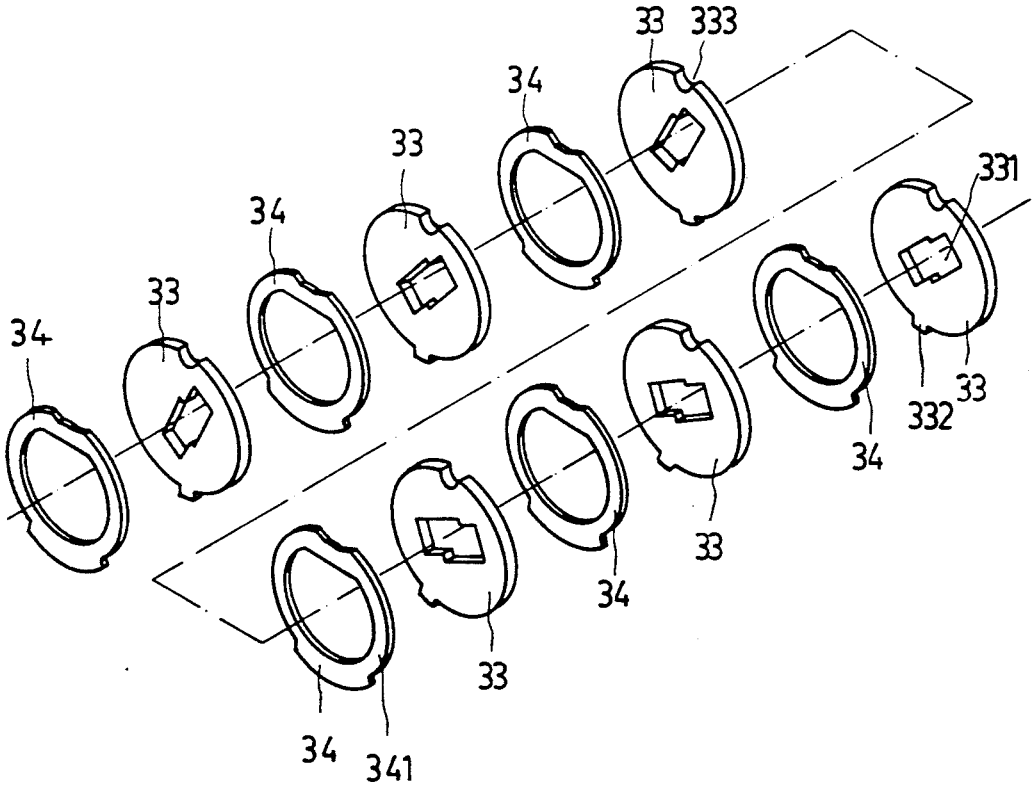
Fig 4-B.C

STRUCTURE OF KEY AND LOCK BARREL FOR LOCK SET

This application is a continuation of Application Ser. No. 07/336,635 filed Mar. 23, 1989, now abandoned, which is a continuation of Application Ser. No. 07/090,365, filed Aug. 28, 1987 and now abandoned.

BACKGROUND OF THE INVENTION

The present invention relates to a new key and lock barrel for a lock set, which is simple to manufacture and assemble and which comprises one holder with one rotating body inside and one catching body posteriorly next to the rotating body, which rotating body comprises multiple washers and barrel plates, wherein the structure works by inserting the key into the rectangular spaces through the washers and barrel plates in a manner such that the turning of key aligns the notches on each washer and barrel plate so that the rotating body receives the catching body in the notches to open the lock; the good match of key and rotating body increases the precision of the mechanism of the present invention and reduces the possibility of error.

SUMMARY OF THE INVENTION

The present invention provides a new key and lock barrel for a lock set, comprising holder, nut, rotating body, braking bar, washers, barrel plates, covering plate and key; the round space of said holder allowing a rotating body to be placed therein; said rotating body containing inside barrel plates and washers with a covering plate mounted in a circular retaining groove on said rotating body to keep the barrel plates and washers in position and with a braking bar placed between the axial structure of the rotating body and the arc-shaped scoop channel of said holder; said key is rectangular in shape and formed in a manner superiorly on right side and inferiorly on left side there are respective L-shaped scoop channels, and vertically to each respective scoop channel there are slant faces having different depths; by means of close contact of the rectangular spaces between key and washers and barrel plates, and through the rotation of said key all the notches of all respective washers and barrel plates will align in one direction and said braking bar will be received in said rotating body so that the rotating body can be freely rotated with the said holder and can drive a corresponding lock plug to open the lock.

BRIEF DESCRIPTION OF THE DRAWINGS

FIG. 2 is a cross-sectional view of the present invention.

FIG. 3-A, 3-B, and 3-C. are plain views of action of rotating body and holder of the present invention.

FIG. 4-A and 4-B are perspective detail views of action of washers and barrel plates of the present invention.

DESCRIPTION OF THE PREFERRED EMBODIMENT

Figure 1:
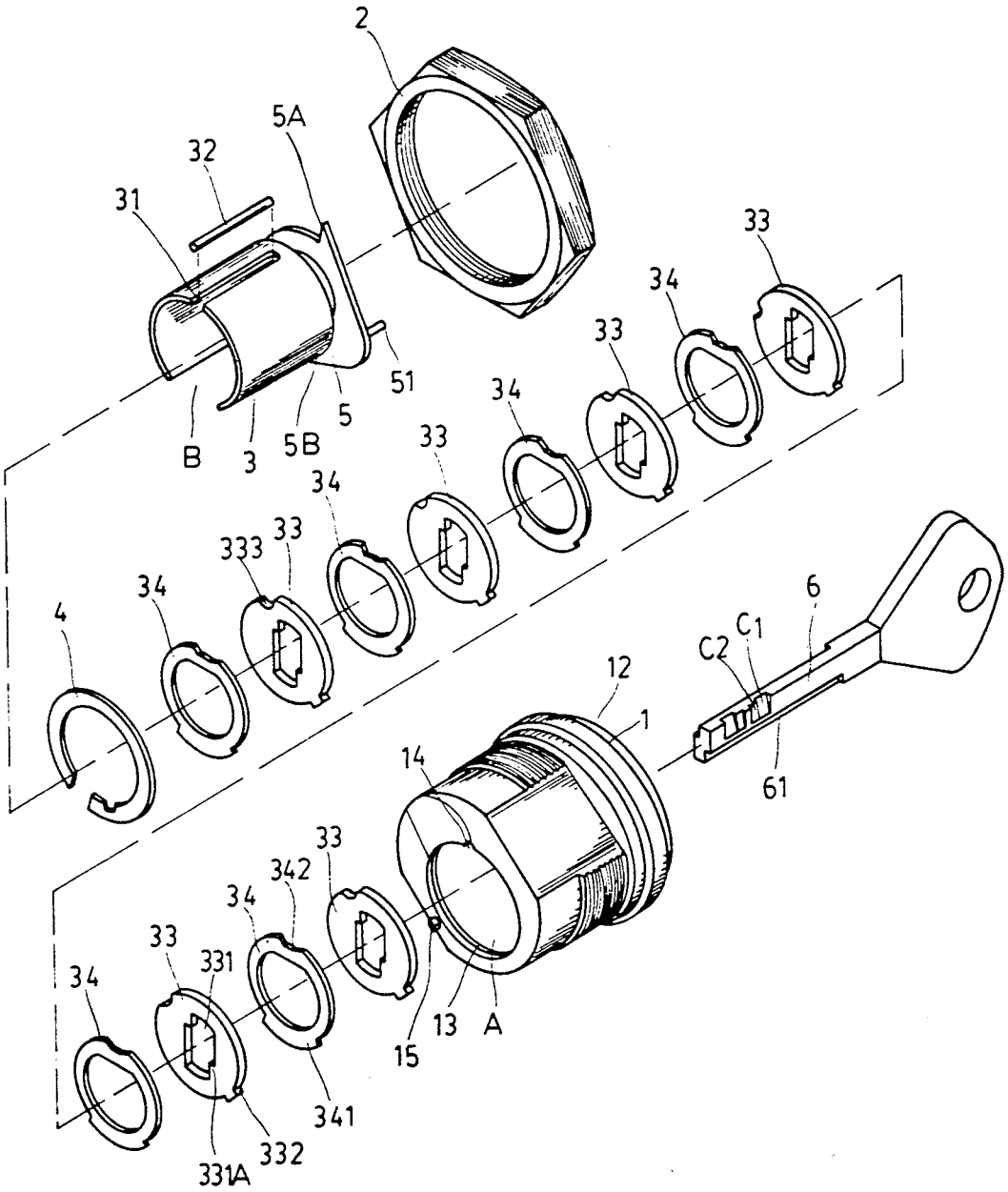
FIG. 1 is a perspective detail view of the present invention.

As shown in FIG. 1 and 2, the present invention comprises one holder (1) which is characterized by its exterior thread (11) for a hexagon nut (2) to fix thereto. Said holder (1) has anteriorly a round open hole (12) for key (6) to insert, and posteriorly a circular retaining groove (13) for a covering plate (4) to fix thereto so as to keep a related rotating body (3) and its inner elements in an axial (longitudinal) location. It has interiorly a round shaped space A for receiving the rotating body (3) and an arc-shaped scoop channel (14) on inner wall for receiving braking bar (32). Said rotating body (3) is opened anteriorly to receive the barrel plates (33) and washers (34), and has on its wall an open space B of a more than 100 degree radial angle with an axial scoop channel (31) opposite to open space B for receiving said braking bar (32), wherein the said braking bar has a diameter bigger than the thickness of the shell of said rotating body (3) and all said barrel plates (33) are divided by respective washers (34). Each barrel plate (33) has interiorly a rectangular space (331) which is characterized by its L-shaped raised face (331A) to match with the key (6), and exteriorly a raised point (332) in the same radial direction and a notch (333) in a different radial location, wherein said raised point (332) of said rotating body (33) helps each barrel plate to slide within open space B of said rotating body. Each said washer has peripherally a raised part (341) to plug in open space B so as to keep the washer from rotating, and a notch (342) corresponding to the radial location of braking bar (32) and the axial scoop channel (31) of rotating body (3). There is a covering plate (4) available at the posterior part of said rotating body (3) which is fixed to the retaining groove (13) of said holder (1) so as to keep rotating body (3) within said holder (1). There is also a catching body (5) permanently attached posteriorly to rotating body (3), which catching body (5) has a raised button to contact a posterior lock plug, and raised parts (5A) and (5B) along its circumference to match with the corresponding part (15) of holder (1) so as to keep catching body (5) and rotating body (3) in a limited rotation. The key (6) which matches with rotating body of the present invention is formed in a rectangular shape, comprising superiorly on the right side and inferiorly on the left side one each L-shaped scoop channel (61) to match with raised faces (331A) of barrel plates so as to keep the key (6) in position when it is inserted into rotating body (3). The key has slant faces (C1), (C2) . . . in different depths vertically against the direction of the L-shaped scoop channel to match with the different radial location of the notch (333) of each barrel plate (33).

The present invention is based on the following principle and methods.

1. The principle applied in the present invention is the use of an element of different radial design by means of one rotation to drive all corresponding bodies of the same specification from different specific locations to one location and to make another corresponding specific element move to the same location so as to continuously rotate.

2. The present invention is to make use of a slant face (C1), (C2) . . . of the key (6) which have different depths. If the key (6) is inserted into the round hole (12) through the central part of all barrel plates (33) when it is rotated, the slant faces (C1), (C2) . . . will longitudinally contact and move all corresponding barrel plates in an order according to the depth of slant face. As soon as the barrel plate is at a position so that its raised point (333) is braked by the side wall of the open space of rotating body (3), if the key is turned father the rotating body (3) will be driven to rotate together.

3. In regular situation, the braking bar (32) of rotating body (3) is partly inside the wall of rotating body (3)

and partly inside the arc-shaped scoop channel (14) of the inner wall of holder (1) so that rotating body (3) can not rotate against holder (1). When in the process as above-mentioned in item 2, that the barrel plate (33) firstly is rotated to a point where the rotating body (3) brakes this barrel plate (33), all the notches of barrel plates will then be turned to the location of braking bar (32) which is partly fixed inside the axial scoop channel (31) of the rotating body (3), and if the key (6) is turned farther the rotating body (3) will rotate, the braking bar (32) will fall into the notches (333) and (342) of respective barrel plates and washers so as not to let braking bar (32) interfere with the holder (1) to open the lock in such a manner that rotating body (3) can smoothly rotate and drive a corresponding lock plug.

4. To lock the process is reversed.

The following are supplements to the application of the present invention:

1. According to the present invention, when the preferred embodiment is locked, the raised points (332) of all barrel plates (33) are in one radial location along one side of the open space B of rotation body (3) while the notches (333) of the barrel plates are in different radial locations; in the process of first rotation period as shown in FIG. 3-A, all barrel plates (33) are driven to rotate and the rotating body (3) remains immovable; the process of second rotation period as shown in FIG. 3-C, causes the rotating body (3) and its barrel plates (33) and washers (34) to start rotating altogether (washers and rotating body start to turn in solidarity while barrel plates are driven to rotate with rotating body in a manner that the braking bar (32) falls into the notch (333) of all barrel plates so as to keep all barrel plates in one radial location and not turn one against another.

2. In the process of second rotation period, the raised part (5A), (5B) of catching body (5) is posteriorly attached to rotating body (3) and the corresponding raised part (15) of the holder (1) to brake each other to determine the range of rotation of the rotating body (3).

3. Either in the process of first rotation period or in second period, all the slant faces (C1), (C2) . . . of the key (6) of different depth contact and move all respective barrel plates (33) in different time of action one after another in such a manner that all barrel plates (33) are in a different radial location and each shallow slant face can not cross over the rectangular space (331) of another barrel plate (33) so that the key (6) can not be taken out from rotating body.

4. Slant faces (C1), (C2) . . . are symmetrically available on opposite angles of the key (6) so that the turning of the key (6) after it is inserted into all rectangular spaces (331) of barrel plates (33) will make the key (6) symmetrically contact two points of each barrel plate (33) on opposite angle.

5. According to the present invention, the structure and form of the key (6) for the preferred embodiment breaks through conventional products in design, and the matching lock can only be opened by the corresponding key which is characterized by its variety and simple structure to match with barrel plates (33) in many ways for high security and precision.

To view generally all the above mentioned, the present invention has following advantages:

1. Because neither bearing plugs nor springs have been used in the present invention, the embodiment of the present invention is better than conventional products in performance, ease of assembly as well as in prevention of burglary.

2. The key for the present invention matches with the rectangular space (331) of all barrel plates (33), which can be made more durable than other conventional products and will not be easily twisted or deformed after a long period of use as usually seen in conventional products.

3. Because the key for the present invention is characterized by its slant faces and L-shaped scoop channels on crossed opposite angles to match with the corresponding raised faces (331A) of barrel plates (33) for precisely positioning, the preferred embodiment of the present invention can prevent any probe with improper material.

4. According to the present invention, when the key (6) is inserted into all rectangular spaces (331) of barrel plates (33) of rotating body (3), the rectangular form of the key (6) makes a good match and can mutually and closely contact with all rectangular spaces (331) of barrel plates (33) to minimize error and to conveniently, precisely and very practically operate in opening the lock.

I claim:

1. A lock set comprising:

a key, a holder, a rotating body disposed within said holder and containing a plurality of barrel plates and washers, a washer being disposed between each pair of plates, said key being generally rectangular in cross section along the shank length thereof and having one L-shaped scoop channel extending longitudinally along a lower edge of one side of said key with a second L-shaped scoop channel extending longitudinally along an upper edge of the other side of said key, and a plurality of mutually spaced slant faces disposed vertically transverse to the longitudinal extension of each said L-shaped scoop channel along each side of said key, said slant faces disposed on said one side being disposed along an edge opposite said lower edge and said slant faces disposed on said other side being disposed opposite said upper edge, each said slant face having a predetermined depth, said slant faces being vertically opposed having the same predetermined depth, said washers having axial holes therethrough and each plate having an axial hole therethrough, each said axial hole including a first step corresponding to said first L-shaped scoop channel and a second step diametrically opposed to said first step and corresponding to said second L-shaped scoop channel, each plate corresponding to said rectangular cross section of said key with the scoop channels, but without the slant faces, each washer and plate having a peripheral notch, a breaker bar carried by said rotating body so that when the key is inserted therein and rotated until said notches receive said bar said body will rotate relative to said holder to drive said lock set.

* * * * *